United States Patent [19]

deMey, II

[11] 4,335,971

[45] Jun. 22, 1982

[54] RECORDER PAPER DRIVE

[75] Inventor: Charles F. deMey, II, West Redding, Conn.

[73] Assignee: The Perkin-Elmer Corporation, Norwalk, Conn.

[21] Appl. No.: 128,210

[22] Filed: Mar. 7, 1980

[51] Int. Cl.[3] ..... B41J 11/04; B41J 11/36; B41J 15/04

[52] U.S. Cl. ..... 400/619; 400/617; 400/579; 400/659

[58] Field of Search ..... 400/613.2, 613.3, 613.4, 400/615, 615.1, 624, 625, 585, 585.1, 579, 588, 641, 662, 659, 619, 617; 226/192, 190, 191, 185, 189; 271/272, 273, 274, 162, 164, 4; 26/51.3

[56] References Cited

U.S. PATENT DOCUMENTS

| | | | |
|---|---|---|---|
| 1,540,359 | 6/1925 | Miller | 400/613.2 |
| 1,616,071 | 2/1927 | Waldheim | 400/613.4 X |
| 2,104,484 | 1/1938 | Janney | 400/615.1 X |
| 2,566,959 | 9/1951 | Petz | 400/615.1 X |
| 3,001,682 | 9/1961 | Carroll et al. | 226/192 |
| 3,099,376 | 7/1963 | Kennedy | 226/190 X |
| 3,353,646 | 11/1967 | Young | 400/161.1 |
| 3,666,156 | 5/1972 | Becker | 26/51.3 |
| 3,847,261 | 11/1974 | Matsuhisa | 400/585.1 |

FOREIGN PATENT DOCUMENTS

| | | | |
|---|---|---|---|
| 442784 | 1/1968 | Switzerland | 226/190 |

*Primary Examiner*—Edgar S. Burr
*Assistant Examiner*—C. A. Pearson
*Attorney, Agent, or Firm*—S. A. Giarratana; F. L. Masselle; R. A. Hays

[57] ABSTRACT

A platen roller type printer/plotter is provided having a paper supply which is frictionally driven by the platen. The plate comprises at least three pieces which are mounted on a drive shaft with the centermost of the pieces being keyed to the shaft to rotate therewith while the other pieces of the platen are free to turn about the shaft at the same or different speeds. A paper supply is fed to the platen with a pressure roller in the middle which bears upon the central platen piece and will drive the paper straight if it is started straight. However, if the paper is put into the platen loose and skewed, driving the center platen roller pulls the paper up tight and aligns it automatically. This is due to the differential action of the different pieces of the platen since only the center piece is keyed to the shaft.

An input tray which holds the paper is pivoted under the paper. Accordingly, when the paper is presented to the platen at an angle, the tray moves with the paper reducing the angle error. By providing a multiple roller platen which is driven from the center, and a pivotal tray for feeding paper to the platen, the present invention removes the need for paper drive adjustments.

8 Claims, 5 Drawing Figures

RECORDER PAPER DRIVE

BACKGROUND OF THE INVENTION

This invention relates to a platen roller type recorder or printer/plotter in which a paper supply is frictionally driven by the platen and, more particularly, to such apparatus having a multiple roller cylindrical platen with the paper supply being driven by the center roller of the platen.

In the conventional platen roller type recorder or printer/plotter, a one-piece platen is utilized and the paper is either supplied thereto by parallel sprockets aligned with holes in the edges of the paper supply or the paper supply is driven by frictional contact with the platen. Sprocket drives, although providing an excellent paper feed and alignment require extra parts, must have the drive synchronized, and must have special paper with holes that mesh with the sprockets, all of which add to the complexity and expense of the equipment in which the recorder is utilized.

When the paper is frictionally driven by the platen, if the ends of the platen are not of exactly the same diameter—which is difficult to achieve with metallic platens and practically impossible to achieve with rubber—the larger end of the platen drives the paper faster than the smaller end. This results in skewing of the paper which gets progressively worse as more and more paper is fed to the platen. Also, in such frictional drive arrangements, the paper is usually held against the platen by at least two rollers which are located in the proximity of the ends of the platen. This compounds the problem because the paper is forced to be driven at different speeds by the different size ends of the platen with no chance to slip to accommodate the difference in size between the ends.

Another problem occurs when the paper supply is not fed perfectly square to the platen. When the paper is presented at an angle, it tends to spiral along the platen and ultimately is driven off the end thereof. Careful adjustment can align the paper and correct this problem but such adjustment is time-consuming and costly. Furthermore, repeated adjustments may be required during the operation of the recorder as, for example, in the use of a folded paper supply which has not been folded perfectly square, or when new supplies are required on the exhaustion of the paper supply.

SUMMARY

Accordingly, it is an object of this invention to provide a new and novel platen roller type recorder which prevents skewing of paper when driving the paper by friction.

A further object of this invention is to provide a new and improved platen roller type recorder which automatically squares the paper supply as it is being fed to the platen thereby eliminating the necessity for the time-consuming job of carefully adjusting the alignment of the paper supply to the platen.

Another object of this invention is to provide a new and improved frictional paper drive system for a roller type platen recorder which eliminates the requirement for any paper drive adjustments during assembly of the unit.

Still a further object of this invention is to provide a new and improved paper drive system for a roller type platen printer which is simple in construction, easy to assemble and less expensive than previous systems of the frictional drive type.

In carrying out this invention in one illustrative embodiment thereof, a platen roller type printer/plotter frictionally drives a paper supply. A multiple piece cylindrical platen is positioned on a drive shaft with a means in the center of the platen for driving the paper. The paper supply is fed to the platen and is driven from the center of the platen with at least two end pieces of the platen being free to idle about the drive shaft at different speeds. This provides a differential action between the portions of the platen moving at different speeds which aligns and prevents the skewing of the paper as it is being driven. The roller type platen assembly includes a pivotally mounted input tray which holds the paper supply being fed to the platen in order to insure that the paper is fed square with respect to the platen.

BRIEF DESCRIPTION OF THE DRAWINGS

The invention, together with further features, objects, aspects and advantages thereof, will be better understood from the following description taken in conjunction with the accompanying drawings.

DESCRIPTION OF THE PREFERRED EMBODIMENTS

Figures 3, 4, 5:
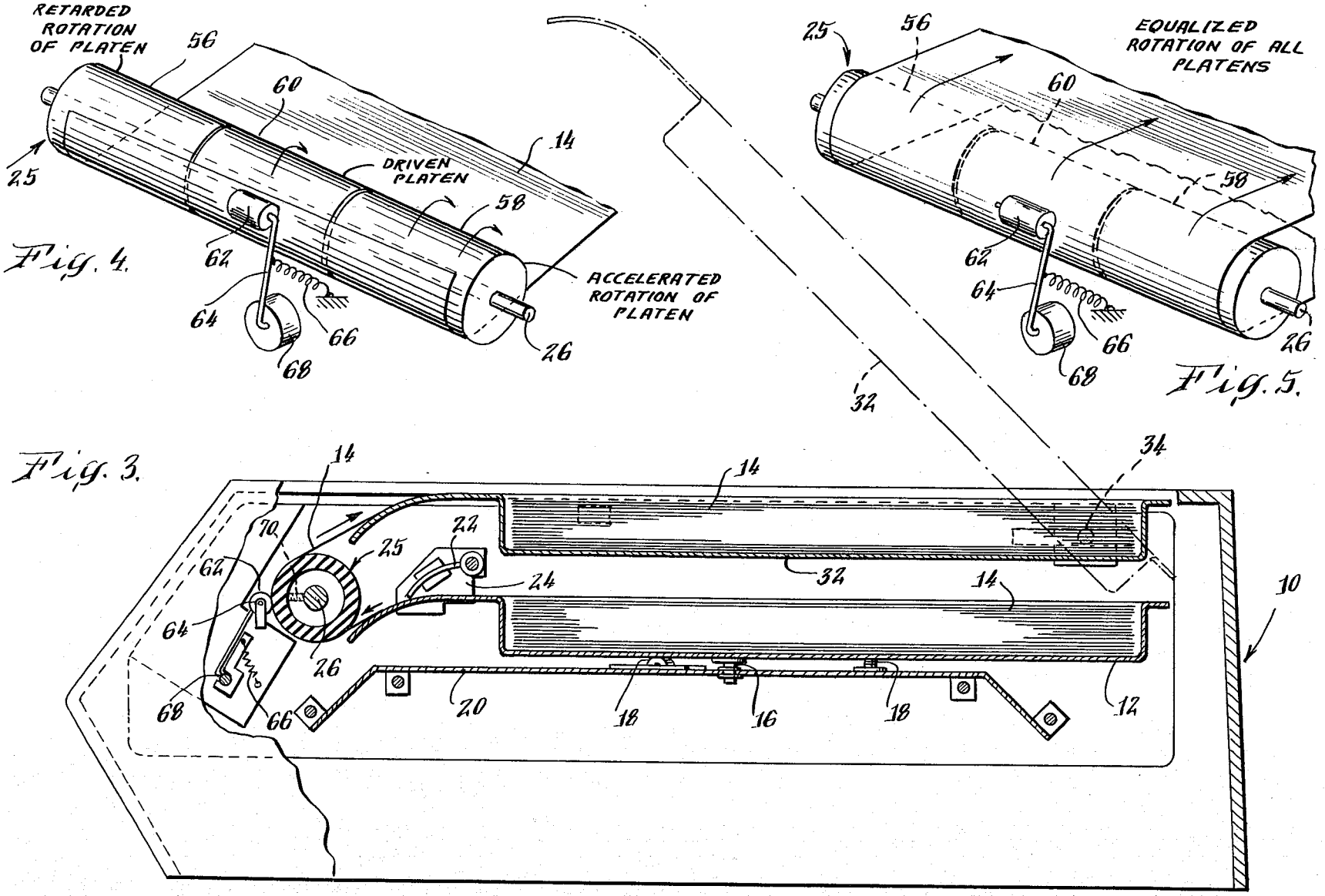
FIG. 3 is a cross-sectional view taken along the 3—3 of FIG. 1 also illustrating in dotted form the paper receiving output tray in elevated position to permit refilling the paper supply.
FIG. 4 is a perspective view of the multiple piece platen in accordance with the present invention illustrating different drive speeds along the platen.
FIG. 5 is a perspective view similar to FIG. 4 illustrating the equalized rotation of all the platen rollers of the multiple piece platen resulting when the paper tightens along all sections of the platen.

Referring first to FIG. 3, a recorder or printer/plotter unit, referred to generally with the reference character 10, includes an input paper tray 12 for accommodating a fan folded thermal sensitive paper supply 14 which is pivotally mounted on a tray pivot 16 and rides on a plurality of support rollers 18 all of which are mounted on a chassis 20. The paper 14 is fed from the input tray 12 past a switch lever 22 mounted on a bracket 24 to a platen 25. The paper 14 is frictionally driven by the platen 25 having a platen shaft 26 extending therethrough which is driven by a paper drive motor 30 (see FIG. 1). The paper 14 is fed from the platen 25 into a paper receiving tray 32 which is hinge mounted about pivot 34 in the unit 10 to accommodate lifting the tray 32 so that the paper supply may be replenished when it is exhausted.

Figure 1:
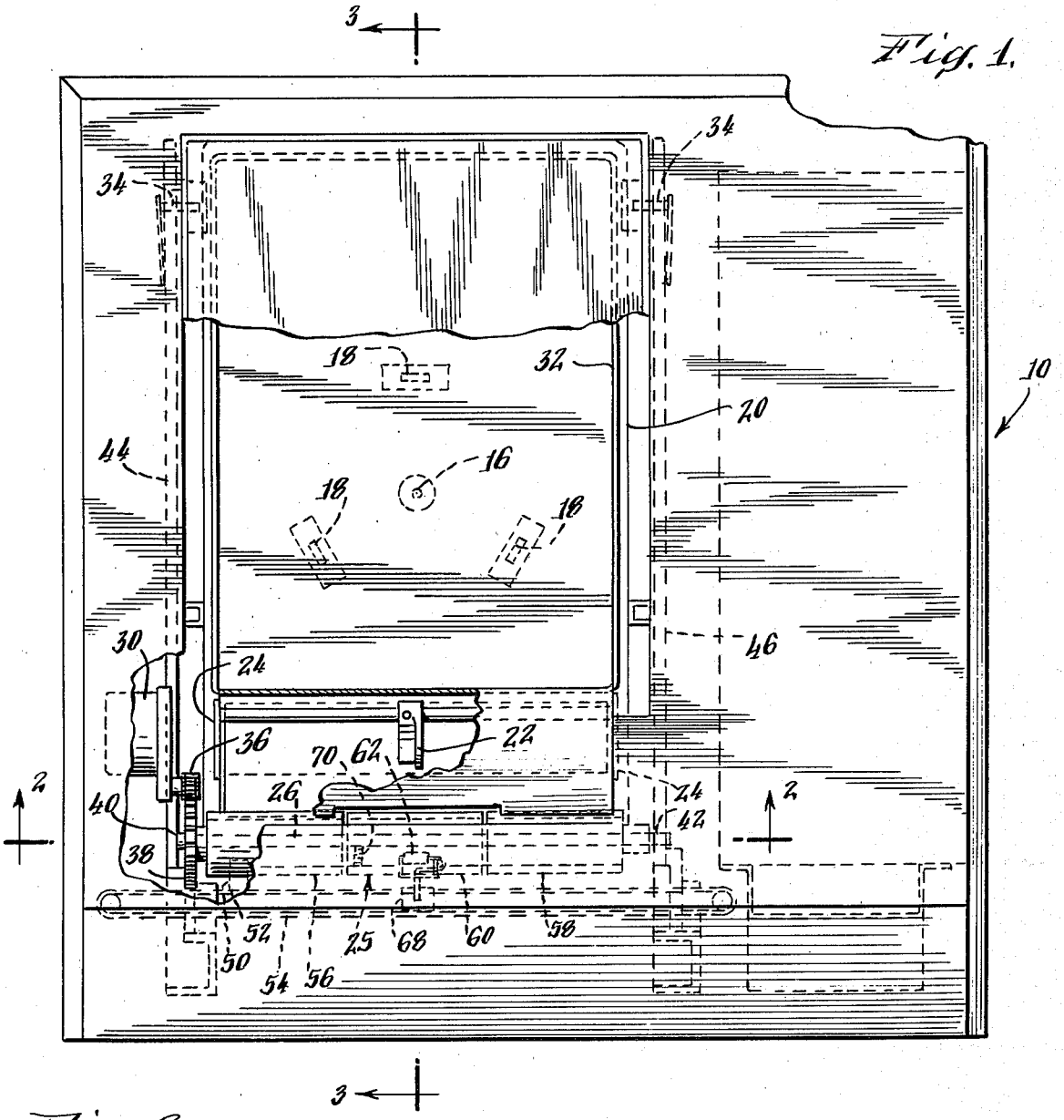
FIG. 1 is a top plan view, partly broken away, of the platen roller type printer/plotter embodied in this invention.
Figure 2:
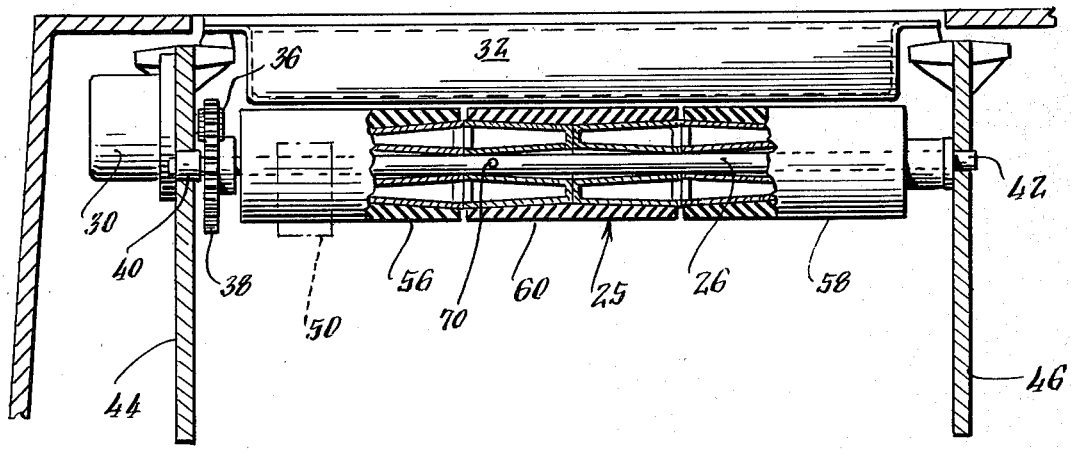
FIG. 2 is a cross-sectional view taken along line 2—2 of FIG. 1.

As will be seen in FIGS. 1 and 2, the paper drive motor 30 drives a gear 36 which, in turn, drives a gear 38 which is fixed to platen drive shaft 26. The drive shaft 26 is mounted for rotation in bearings 40 and 42 which are mounted in side frames 44 and 46, respectively. The motor 30 thus drives the platen 25 through the gearing 36 and 38 which is coupled to the shaft 26 and the platen 25 frictionally drives supply paper 14 from the input paper tray 12 into the output receiving tray 32. A thermal print head 50 coupled to and driven by a belt 54 by the printer linkage 52 is driven by the belt across the platen 25 for recording information on the paper 14. The details of the print head and its drive as well as its drive motor are not shown in detail since they form no part of the present invention and are conventional. For example, they may be of the type utilized in the Sigma 10 gas chromatograph manufactured by Perkin-Elmer Corporation of Norwalk, Conn.

In order to prevent skewing of the paper in friction type drives, as will best be seen in FIG. 2, the platen 25 consists of three parts, namely rollers 56, 58 and 60. The roller 60 is keyed to the shaft 26 by a screw or pin 70 for simultaneous rotation therewith. The end rollers 56 and 58 of the platen 25 are free to turn at different speeds since they are not keyed nor mounted for rotation with the shaft 26.

The paper supply 14 is driven from the center of the platen by applying a pressure roller 62 to the paper 14 on center roller 60 (See FIGS. 3 and 4). The pressure roller is attached to a shaft 64 which is biased and urged toward the center roller 60 by a pressure roller spring 66 with the shaft being mounted in a pressure roller pivot 68.

In operation assume that the paper is fed to the platen 25 at a skewed angle. When one edge of the paper is not pulled up tight against a platen section such as roller 56 in FIG. 4, that section need not turn. The center driving roller 60 pulls the paper up and the other section 58 rotates on the shaft until the paper is tight along the entire platen length. At that time all rollers 56, 58 and 60 turn together in the manner illustrated in FIG. 5. By driving the paper in the center through roller 60 being keyed to the shaft 26 and permitting the end rollers 56 and 58 to idle, if the paper is started straight on the center roller 60, it will be driven straight. Furthermore, if the paper is put on the platen 25 loose or skewed, the center roller 60 will pull the paper tight and align it automatically. Depending upon the way the paper is skewed, either roller 56 or 58 will be rotated while the other end roller does not move or does not move as fast until the paper is aligned on the platen 25. Then the multiple piece platen 25 will rotate as one.

As described in connection with FIG. 3, the input paper tray 12 is pivoted on tray pivot 16 and is free to move about the pivot 16 on a plurality of rollers 18, the positions of which are best illustrated in dotted form in FIG. 1. This simple structure is for the purpose of presenting the paper exactly square to the platen. When the paper 14 is presented to the platen 25 at an angle, the paper tends to spiral along the platen and drive off the end. This requires careful adjustment and alignment which is time-consuming and expensive. With the construction that is shown, the tray 12 holding the paper 14 is pivoted under the paper. At any angle other than 90°, the pivoted tray presents the paper to the platen at an angle such that the spiralling paper tends to spiral towards the center of the platen. However, due to the position of the paper tray pivot, as the paper spirals toward the center of the platen, the angle between the platen and paper gets closer to 90°.

Thus, the spiralling effect finally diminishes to zero when the angle is 90°, which is designed to be the center of the platen. Any tendency of the paper to move from 90° and the platen center introduces an angle, due to the pivot position, that drives the paper back to center, because of the same effect as discussed above.

At the end of the paper supply 14, the switch lever 22 is actuated stopping the operation of the unit 10 when most of the paper is in the paper receiving tray 32. The tail end of the paper remaining around the platen 25 is pulled out when the paper receiving tray 32 is lifted from the front and pivots upward from the pivot 34 to the position illustrated in dotted form in FIG. 3. A new supply of paper is then installed in the input tray 12 and directed under the pressure roller 62. The closing of the top or paper receiving tray 32 activates the paper control devices and operates the switch lever 22 to restore the unit to printing operation.

This simple, multiple piece platen centrally and frictionally drives a paper supply which is housed in a pivoted tray for preventing the skewing of paper being fed to the platen roller type printer/plotter device. The structure eliminates the requirement for careful adjustment and alignment and insures reliable paper feed to the unit. Although the unit has in some respects been described with respect to its utilization in a gas chromatograph, it will be appreciated that the invention may be applied equally as well to any application which employs a paper supply frictionally driven by a platen roller.

Since other changes and modifications varied to fit particular operating requirements and environments will be apparent to those skilled in the art, the invention is not considered limited to the examples chosen for purposes of illustration, and covers all changes and modifications which do not constitute a departure from the true spirit and scope of this invention.

What is claimed is:

1. Paper feeding apparatus comprising, in combination:

means for preventing skewing of paper as it is being fed, said means comprising;

a multi-section cylindrical platen positioned for receiving an elongated web of paper, said platen having at least a center section and two end sections, means for driving only the center section of said platen to thereby feed said paper, means for mounting the end sections of said platen to rotate freely and to be driven only by movement of said paper, an input paper tray for supplying said elongated web of paper to said platen, and means for permitting the paper web to continuously align said tray as said web is being fed, said last named means comprising a pivotal mounting for said input paper tray adjacent to said platen to permit movement of said paper to continuously align the tray with respect to said platen.

2. The paper feeding apparatus of claim 1, wherein said multi-section cylindrical platen comprises a center roller and two end rollers mounted on a drive shaft, the center roller being secured to said shaft for rotation therewith, and the end rollers being free to independently rotate about said drive shaft.

3. The paper feeding apparatus according to claim 1, wherein said means for driving said paper at the center section of said platen includes a pressure roller positioned centrally on said platen, and means for pivotally in two degrees of freedom biasing said pressure roller against said paper on said platen.

4. The paper feeding apparatus according to claim 2, wherein said means for driving said paper at the center section of said platen includes a pressure roller positioned centrally on said platen and means for pivotally biasing said pressure roller against said paper on said platen.

5. The paper feeding apparatus according to any one of claims 1 to 4 further comprising a printing means which traverses said paper along said platen.

6. The paper feeding apparatus according to any one of claims 1 to 4 wherein said pivotally mounted input paper tray is positioned for movement on a plurality of rollers equally spaced about said pivotal mounting.

7. The paper feeding apparatus according to any one of claims 1 to 4 further comprising an output paper tray pivotally mounted above said input tray to receive the paper discharged by said platen, said output paper tray being pivotable to an open position for gaining access to said input paper tray in order to refill the same.

8. The paper feeding apparatus according to any one of claims 1 to 4, wherein said pivotally mounted input paper tray is positioned for movement on a plurality of rollers equally spaced above said pivotal mounting, and wherein said apparatus further comprises an output paper tray pivotally mounted above said input tray to receive the paper discharged by said platen, said output paper tray being pivotable to an open position for gaining access to said input paper tray in order to refill the same.

* * * * *